US006843026B2

(12) United States Patent
Hoehn

(10) Patent No.: US 6,843,026 B2
(45) Date of Patent: Jan. 18, 2005

(54) CONE SHAPED POLYGON ROOF STRUCTURE

(76) Inventor: Steven Hoehn, P.O. Box 159, Corydon, IN (US) 47112

( * ) Notice: Subject to any disclaimer, the term of this patent is extended or adjusted under 35 U.S.C. 154(b) by 30 days.

(21) Appl. No.: 10/080,860

(22) Filed: Feb. 22, 2002

(65) Prior Publication Data

US 2003/0159369 A1 Aug. 28, 2003

(51) Int. Cl.[7] ..... E04B 7/00

(52) U.S. Cl. ..... 52/82; 52/639; 52/91.1; 52/693

(58) Field of Search ..... 52/82, 639, 693, 52/91.1, 91.3, 93.1

(56) References Cited

U.S. PATENT DOCUMENTS

| | | | | | |
|---|---|---|---|---|---|
| 481,347 | A | * | 8/1892 | Cunningham, Jr. | |
| 2,698,178 | A | | 12/1954 | William | |
| 3,214,872 | A | * | 11/1965 | Vogelgesang | 52/82 |
| 3,543,455 | A | | 12/1970 | Walsh | |
| 4,069,527 | A | * | 1/1978 | Harris | 5/362 |
| 4,173,855 | A | * | 11/1979 | Raptoplous | 52/82 |
| 4,275,534 | A | * | 6/1981 | Porter | 52/82 |
| 4,332,116 | A | | 6/1982 | Buchanan | |
| 4,426,814 | A | * | 1/1984 | Stuhmer | 52/82 |
| 4,739,594 | A | | 4/1988 | Langford et al. | |
| 5,029,420 | A | * | 7/1991 | Goto | 52/82 |
| 5,197,241 | A | * | 3/1993 | Romeo et al. | 52/82 |
| 5,444,943 | A | | 8/1995 | Schelforst | |
| 6,244,010 | B1 | * | 6/2001 | Sluiter | 52/643 |
| 6,293,057 | B1 | * | 9/2001 | Amos Hays | 52/79.1 |
| 6,349,511 | B1 | * | 2/2002 | McAlpin et al. | 52/82 |
| 6,438,920 | B1 | * | 8/2002 | Tobey et al. | 52/639 |

* cited by examiner

*Primary Examiner*—Carl D. Friedman
*Assistant Examiner*—Basil Katcheves
(74) *Attorney, Agent, or Firm*—Liniak, Berenato & White, LLC

(57) ABSTRACT

A roof structure for a building in the form of a cone shaped polygon is disclosed. The roof structure includes at least three multi-element trusses attached on corresponding ends to a vertically extending central column. Each of the trusses is rotationally displaced from adjacent ones of the trusses, as measured in a horizontal plane, preferably, by the same angle. Each of the trusses is inclined outwardly and downwardly from the central column to form a series of triangularly shaped roof segments between adjacent ones of the trusses and so as to provide the roof structure shape. The central column may be a vertically extending length of hollow pipe and is essentially non-load supporting, whereby a lower end of the column is vertically spaced above a support structure for outer peripheral edge portions of the trusses. The support structure may be a series of wood posts, a different one of which is attached on an upper end portion to an outer peripheral edge portions of a corresponding one of the trusses.

24 Claims, 6 Drawing Sheets

CONE SHAPED POLYGON ROOF STRUCTURE

BACKGROUND OF THE INVENTION

This invention relates to a roof structure for a building including a vertically extending essentially non-load supporting central column which is spaced above supporting structure for the roof structure, and at least three trusses joined on their inner ends to the column and extending radially outwardly and downwardly to the roof supporting structure. Each of the trusses is rotationally displaced in a horizontal plane from adjacent ones of the trusses to form at least three triangularly shaped roof segments of a cone shaped polygon configuration.

Broadly speaking, cone shaped polygon roof structures are known in the prior art. See, for example, the gazebo roof disclosed in U.S. Pat. No. 4,739,594 granted to J. D. Langford et al. on Apr. 26, 1988 and the roof structure taught in U.S. Pat. No. 4,332,116 granted to H. A. Buchanan on Jun. 1, 1982. The gazebo roof structure of Langford et al. is made of eight triangularly shaped segments, each segment having two wood side beams of one inch by four inch board joined together at an apex and a series of radially spaced apart cross members. The side beams of the eight segments have inner ends which are mounted in U-shaped brackets secured around a central hub. The roof structure of Buchanan contains fifteen triangularly shaped segments, each segment having two side beams or roof components meeting at an apex, and a series of radially spaced apart cross members. The roof components are supported on their radially inner ends on a support plate which is welded to an upper end portion of a weight supporting central column which extends from floor to ceiling in the reference structure.

None of the prior art roof structures are formed using multi-element truss members. While the gazebo roof structure of Langford et al. contains a non load supporting central hub, the fact that rafters or wood side beams are used severely limits the roof span and, consequently, limits the amount of floor space obtainable under roof. On the other hand, the much greater span of roof structure envisioned by Buchanan requires that his rafters must be supported not only on their radially outer ends by posts or columns, but also by a load supporting floor to ceiling central column in the center of the span.

In the gazebo of Langford et al., adjacent ones of the reference roof supporting posts must be rigidly tied together by cross members to prevent the roof structure from sagging and, thereby, tilt the posts radially outwardly. This would have the effect of spreading the posts apart at their upper ends, therefore permitting the roof to sag and, ultimately, the building to collapse. The cross members thus prevent the upper ends of the posts from spreading apart and therefore prevent the roof from sagging.

It would be desirable to have a cone shaped polygon roof structure of the size envisioned by Buchanan which can be entirely supported on and around an outer perimeter portion of the structure without need for a span interrupting central weight supporting column and without need for rigidly connecting upper ends of adjacent roof supporting posts together to prevent roof sag.

By means of the present invention, these and other problems encountered in such prior art roof structures are substantially eliminated.

BRIEF SUMMARY OF THE INVENTION

It is an object of my invention to provide a novel truss reinforced cone shaped polygon roof structure.

It is a further object of my invention to provide such a roof structure wherein a plurality of trusses are joined on corresponding ends to an essentially non-weight supporting central column which is elevated above support structure for peripheral end portions of the trusses so that the roof structure forms a free span over any selected diameter of the roof structure.

Briefly, in accordance with my invention, there is provided a roof structure for a building including an essentially non-load supporting, vertically extending central column having a lower end spaced above a supporting structure of the roof structure. The roof structure further includes a plurality of at least three elongated and vertically inclined, multi-element trusses fixedly joined on innermost ends thereof to the central column. The trusses are rotationally displaced from one another in a horizontal plane. Each of the trusses extend radially outwardly and downwardly from the central column to an outer end portion thereof for mounting on the supporting structure at a level spaced below a lower end of the column. The plurality of trusses thereby defines a roof structure in the form of a cone shaped polygon.

These and other objects, features and advantages of the present invention will become apparent to those skilled in the art from the following detailed description and attached drawings upon which, by way of example, only a preferred embodiment and certain modifications of the invention are illustrated.

DETAILED DESCRIPTION OF THE INVENTION

Figure 1:
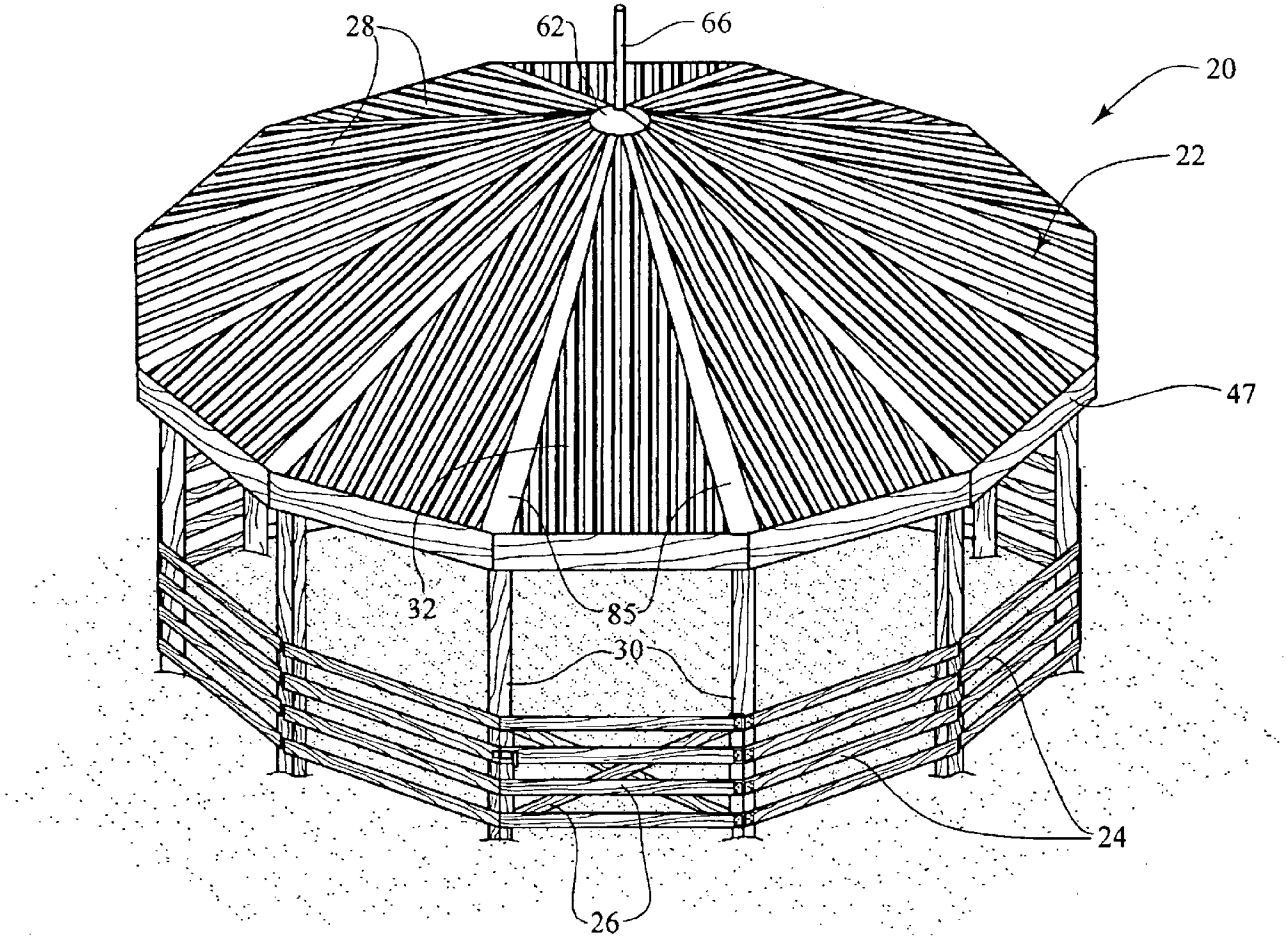
FIG. 1 shows a perspective view of a corral having truss supported cone shaped roof structure, thus illustrating a preferred embodiment of my invention.
Figure 2:
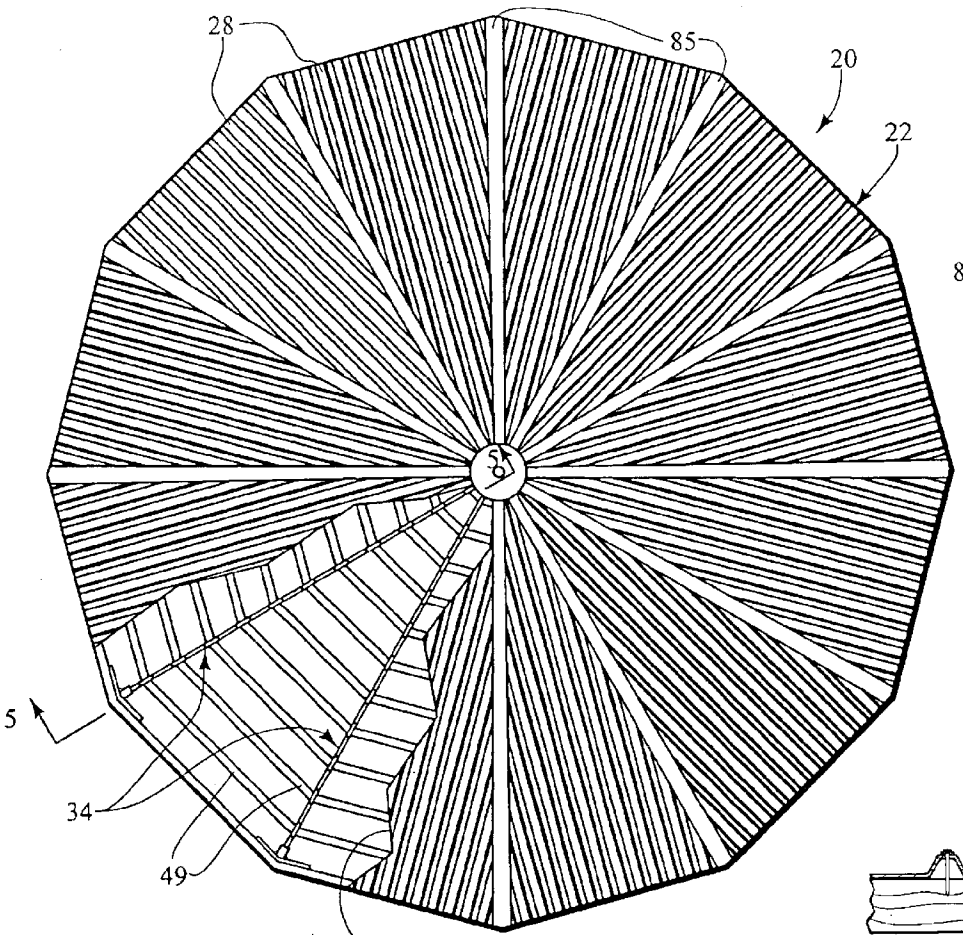
FIG. 2 shows a top plan view of the roof structure of FIG. 1.

Referring now to the drawing figures and, in particular, to FIGS. 1–2, there is shown, in a preferred embodiment of my invention, a building structure, generally designated 20, which includes a novel roof structure, generally designated 22, in the form of a cone shaped polygon. While it can be readily adapted for many different uses, the structure 20 of the present example is shown in the form of a corral for confining animals such as horses or cattle. For this reason, the perimeter of the structure 20 is shown as being enclosed by a board fence of conventional type having a series of adjoining panels 24 and a standard latchable entrance gate 26. It will be appreciated that the building structure 20 could include any number of different types of siding of well known type, as desired, depending, at least in some instances, on the purpose for which the structure is to be used. The roof structure 22 of the present example contains twelve triangularly shaped segments 28, as viewed in plan (FIG. 2), and is fully supported on twelve posts 30 (FIGS. 1, 5 and 7) spaced on and around a perimeter of the roof structure. Each of the posts 30 are located at an intersection between different adjacent pairs of the segments 28. The posts 30 are preferably constructed of wood and each post is preferably square in cross-section with a cross-sectional dimension of 6" by 6" and has a length of 13½ ft, a lower 3½ ft of which is preferably below grade in 2 cubic feet of concrete footing.

Referring now to FIGS. 1–11, details of the roof structure 22 are shown including a conventional corrugated sheet metal roofing 32 and a series of twelve steel trusses 34, each of the trusses having an upper beam 34*a*, preferably inclined at 22 degrees with the horizontal, and a lower beam 34*b*, preferably inclined at a 16 degree angle with the horizontal. Each of the trusses 34 are rotationally displaced from adjacent ones of said trusses by an equal angle of displacement as measured in a horizontal plane and contain a series of vertically extending and radially spaced apart steel spacer members 36, forming a series of truss sections between adjacent ones of the spacer members. In the present example there are four truss sections, each being 5"–6" in horizontal length, and a like series of steel inclined or diagonally extending reinforcing members 38, a different one of which is disposed in each of the truss sections. The beams 34*a* and 34*b* and spacer members 36 can be welded together at their intersections and may be constructed of standard 1½"×1½" hollow box tubing, preferably being at least ⅛" in thickness. The reinforcing members 38 can also be welded on their ends at intersections between the beams 34*a* or 34*b*, as shown, and may be constructed of 1"×1" standard box tubing of at least ⅛" thickness. A radially outer and lower end of each of the inclined members is welded at an intersection between the lower beam 34*b* and a radially outer one of the spacer members 36 forming an outer end of a corresponding one of the truss section. Similarly, an upper radially inner end of each of the inclined members 38 is welded to an intersection between the upper beam 34*a* and a radially inner one of the spacer members 36 which forms an inner end of a corresponding one of the truss section.

Figure 5:
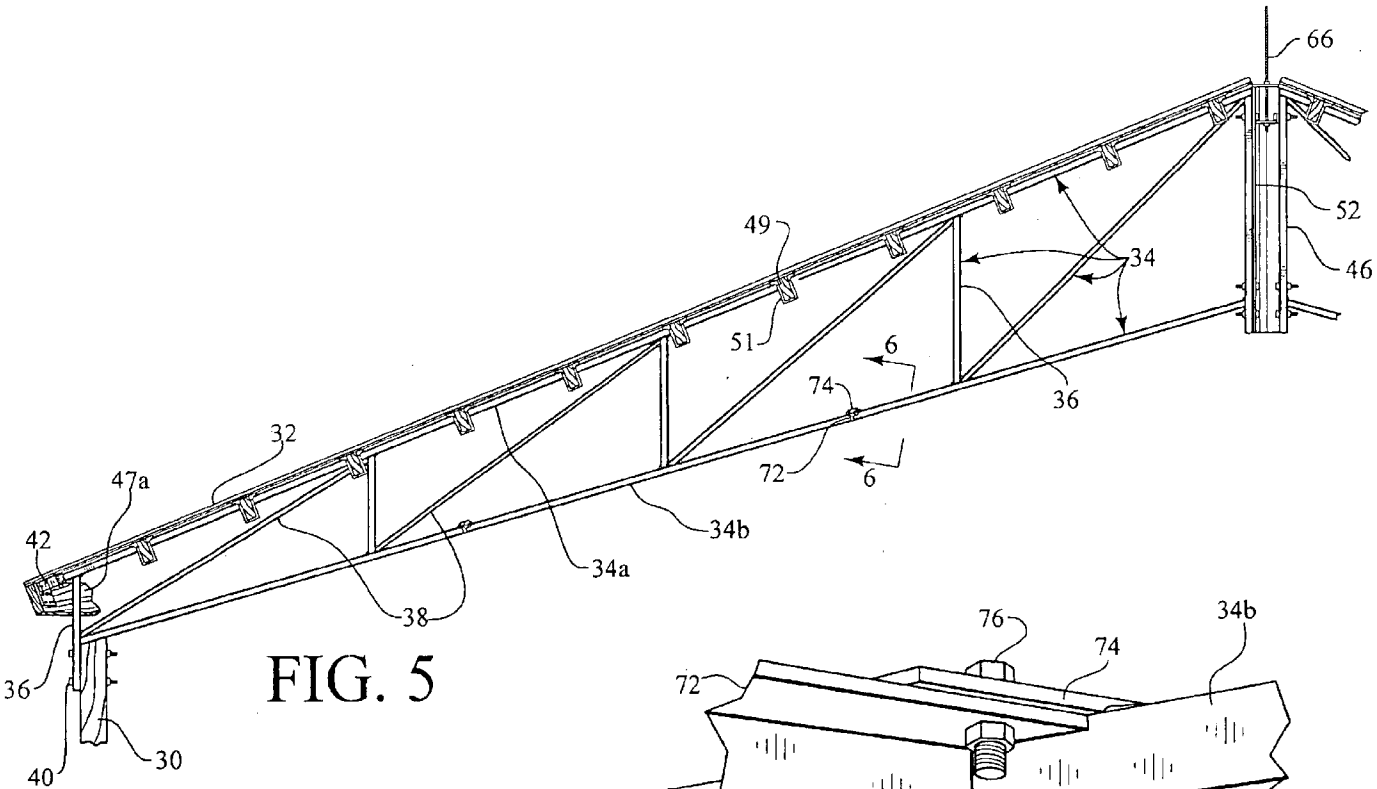
FIG. 5 shows a cross-sectional elevation view of the roof structure of FIGS. 1–2 as viewed along cross-section lines 5—5 of FIG. 2.
Figure 7:
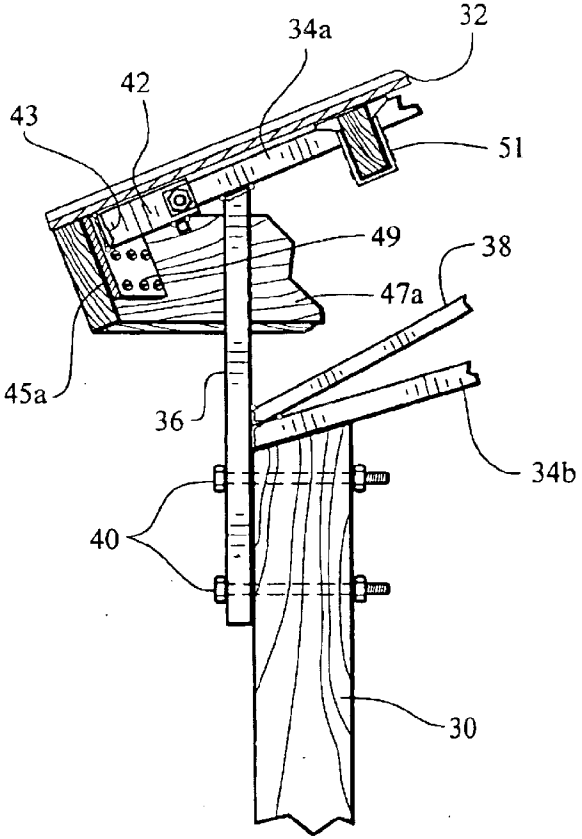
FIG. 7 shows an enlarged detail view of a portion of the roof structure of FIGS. 1–2 and 5, the same as viewed in FIG. 5.

The outermost vertical spacer 36 of each of the trusses 34 extends below a corresponding one of the lower beams 34*b* along an outer facing side of a different one of each of the posts 30, as shown in FIGS. 5 and 7, so that each of the outermost spacers can be joined to an upper end portion of a corresponding one of the posts by conventional fasteners such as nuts and bolts 40. The upper beam 34*a* of each of the trusses 34 is welded to an upper end of a different one of the outermost vertical spacers 36 and extends outwardly beyond the outermost spacer into an end portion of a larger piece 42 of steel box tubing (See FIGS. 7–8), preferably about 6 inches in length and 2"×2" in cross-section. Each upper beam 34*a*, thus inserted into a corresponding box tubing piece 42, is joined to the latter by a nut and bolt 44.

Figure 8:
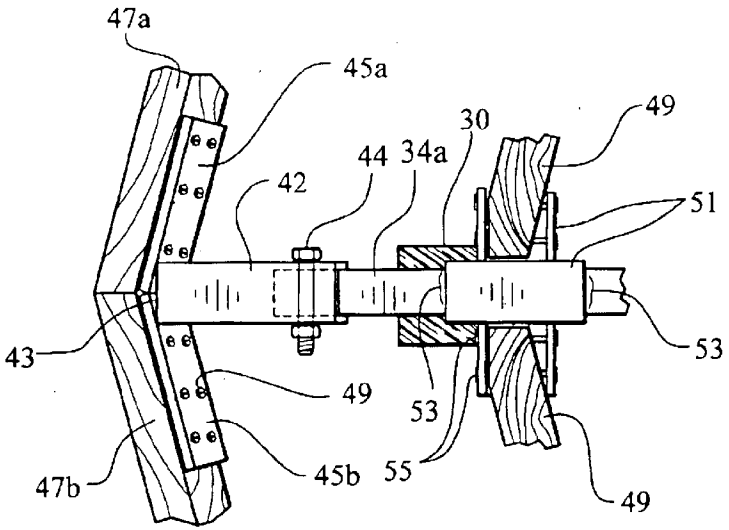
FIG. 8 shows a top plan view of the roof structure portion shown in FIG. 7 with certain parts replaced and with corrugated metal roofing removed.

Referring now specifically to FIGS. 7–8, the outermost end of each of the twelve box tubing pieces 42 is welded, as at 43 (FIG. 7), to an angular intersection between a pair of flat, rectangularly shaped steel mounting plates 45*a* and 45*b*. In the present example, wherein the roof structure 22 contains twelve segments 28, the interior angle between the intersecting plates 45*a* and 45*b* should be 150 degrees. The plates 45*a* and 45*b* are, in turn, fastened to opposing end portions of abutting 2"×6" wood board peripheral trim members 47*a* and 47*b*, respectively (See also 47 in FIG. 1), which trim members contain intersecting ends which are cut on a 105 degree angle of taper relative to their lengths. The trim members 47*a* and 47*b* can be fastened to the plates 45*a* and 45*b*, respectively, with a series of wood screws 49.

Referring now specifically to FIGS. 2, 5, 7 and 8–9, each of the segments 28 contain a series of radially spaced apart 2"×4" wood board upper cross braces 49 of differing lengths which span between and abut adjacent pairs of the upper beams 34*a* of the trusses 34. The cross braces 49 are held at each end in conventional saddle hangers 51 which are fitted over each of the upper beams 34*a* and are welded or otherwise suitably fastened thereto, as, for example, at welds 53 in FIG. 8. The cross braces 49 can then be secured to the saddle hangers 51 by means of suitable wood fasteners such as wood screws or nails 55.

Figure 9:
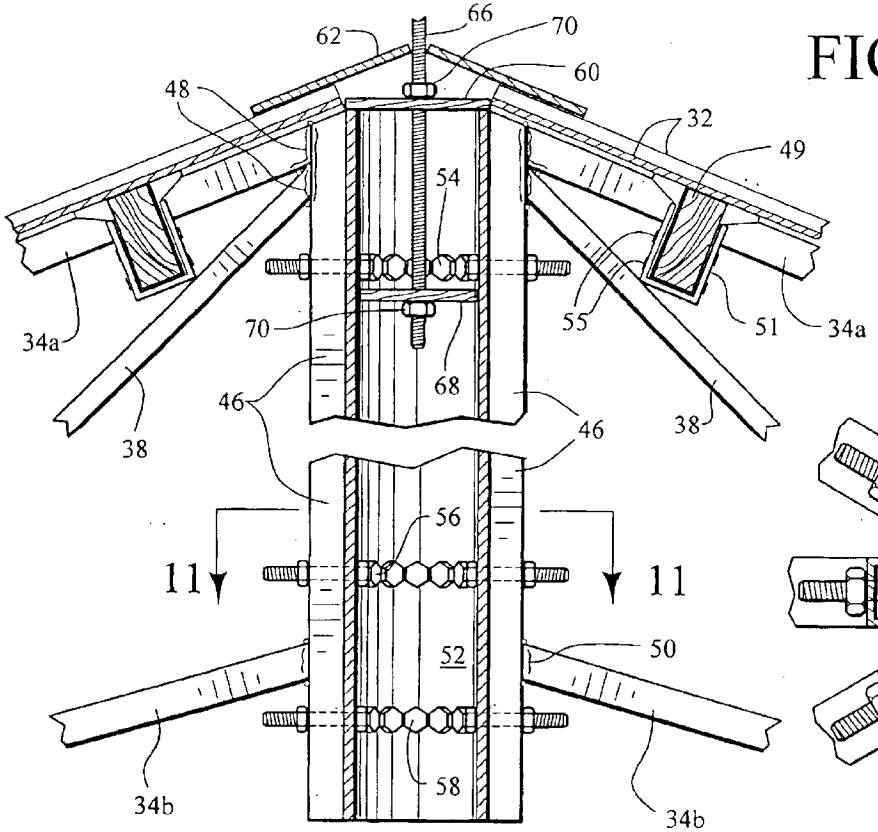
FIG. 9 shows an enlarged detail view of a central portion of the roof structure of FIGS. 1–2 and 5, the same as viewed in the latter mentioned figure.

The innermost end of each of the trusses 34 contains a vertical box tube spacer 46 which is joined to a corresponding innermost end of a corresponding one of the upper beams 34*a*, lower beams 34*b* and incline members 38 by welds as shown in FIG. 9 at 48 and 50. The spacers 46 are, in turn, fastened to and around a hollow cylindrically shaped steel central column 52 (See FIGS. 9 and 11) by means of three vertically spaced apart series of nuts and bolts 54, 56 and 58 (FIG. 9 only). In the present example, the column may be a 6" diameter steel pipe, 4½' long. In any event, the column 52 need only be long enough to permit joinder of the spacers 48 thereto so that the innermost ends of corresponding ones of the beams 34*a* and 34*b* and inclined members 38 can be welded to such spacers. Thus, the need for a floor to ceiling central column is eliminated, allowing the roof structure 22 to be a free overhead span across any diameter thereof. A disc shaped steel plate 60 (FIG. 9) is placed on an upper end of the column 52.

Figure 10:
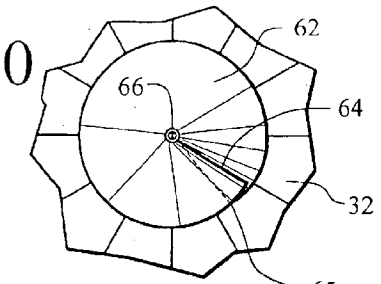
FIG. 10 shows an enlarged detail view of a fragment of the central portion shown in FIGS. 1–2 and 9, the same as viewed in FIG. 2.
Figure 11:
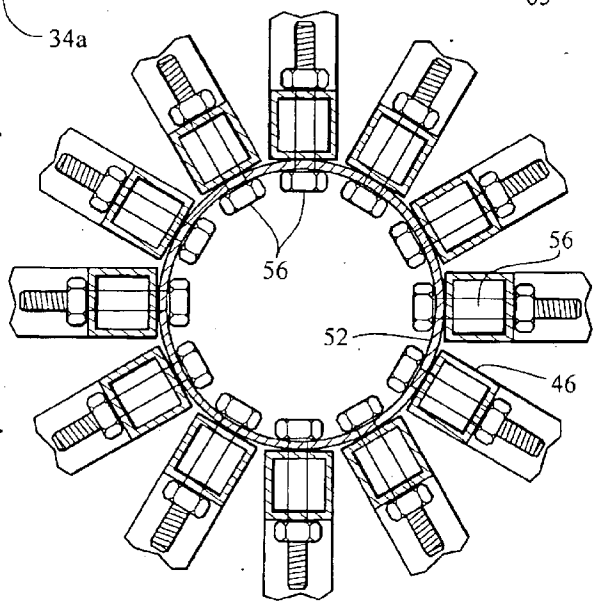
FIG. 11 shows a cross-sectional view of the central portion of FIG. 9 as viewed along cross section lines 11—11 of the latter mentioned figure and with certain parts replaced.

Over the plate 60 and innermost ends of the roofing 32 of the segments 28 is placed a cone shaped sheet metal cap 62 (See FIGS. 9–10), preferably about 2' in diameter, to prevent rain and melt water from leaking between the roofing 32 along the outside surface of the column 52 into the corral below the roof structure 22. The cap 62 may be formed by first cutting a disc shaped piece out of a flat sheet metal, then by cutting along a radius of the piece followed by lapping one of the resulting edge portions 64 over an opposing edge portion 65, as shown in FIG. 10, to form the desired cone shape, as shown in FIG. 9. An elongated central vertical pin 66 with exterior threading on a lower end portion thereof may be inserted through central openings in the cap 62 and plate 60. To stabilize the pin 66, a second plate 68 is disposed within the column 52, so as to be spaced below the plate 60 and is held in place by a nut 70 which is located thereunder around a lower threaded end portion of the pin 66 as shown in FIG. 9.

Figure 6:
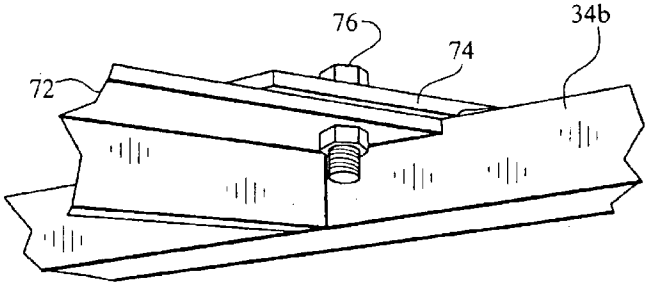
FIG. 6 shows a perspective view of a fragment of the roof structure of FIGS. 1–2 and 5 as viewed along view-lines 6—6 of the latter mentioned figure.

Referring now to FIGS. 5–6, a pair of radially spaced apart lower cross braces 72, preferably made of angle iron, can be placed between adjacent pairs of the lower beams 34*b* to stabilize them. To this end, a flat, rectangular steel plate 74 is welded to an upper surface of the box tubing forming the lower beam 34*b* and, then, overhanging portions of the plate are secured to end portions of the lower cross braces 72 with suitable fasteners, such as a nut and bolt combination 76 as shown in FIG. 6. The resulting trusses 34 of the present example are each 22 feet in horizontal length between an outer face of any one of the posts 30 and a corresponding one of the innermost spacer members 52. The diameter of the interior of the structure 20 of the present example is approximately 43'–9" between opposing interior faces of opposing ones of the posts 30. The interior height of the roof structure 22 varies from about 10 feet, as measured vertically along any one of the peripheral posts 30, up to about 15'-6" at the center of the roof structure between grade, taken at a base of any one of the posts 30, and a lower end of the column 52.

Figure 3:
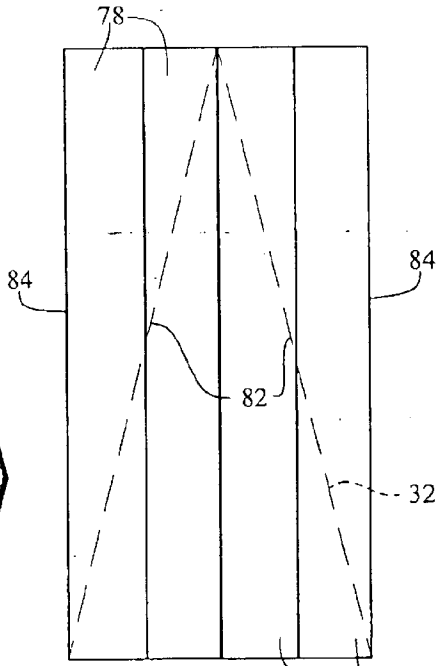
FIG. 3 shows a plan view of four strips of corrugated roofing used on the roof structure of FIGS. 1–2, thus illustrating how the strips are cut to form two segments of the roofing of the subject structure.
Figure 4:
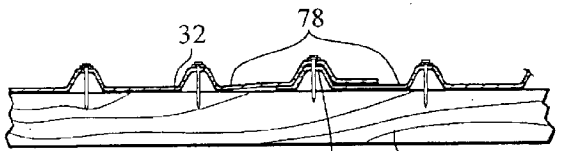
FIG. 4 shows an end elevation view of a portion of the roofing strips of FIG. 3 showing overlapping edges of two adjacent ones of the strips and illustrating the corrugations therein.

Referring now to FIGS. 2–4, to form the triangular segments 28 of the roofing 32, four strips 78 of corrugated roofing sheet having lengths of 24 feet and widths of 38 inches can be laid side-by-side so that opposing sides of adjacent pairs of the strips have a overlapping corrugations 80 along their long dimensions (FIG. 4). The arrangement thus formed is shown in FIG. 3. To form a pair of triangularly shaped pieces of the roofing 32 to cover two of the segments 28, the sheets 78 of FIG. 3 are cut along dashed cut lines 82 as shown The resulting central isosceles triangle, cut along the lines 82 in FIG. 3, forms one of the roofing pieces for covering one of the segments 28. The remaining two right triangular pieces on opposite sides of the central triangle can be joined back-to-back along their sides 84 and, similarly, overlapping two inches to form the other roofing piece for covering a second one of the segments 28. Each of the resulting segments 28 is laid between a different adjacent pair of trusses 34. A standard ridge cap 85 overlaps adjoining segments 28 and is fastened to the wood cross hexes 49.

Figure 16:
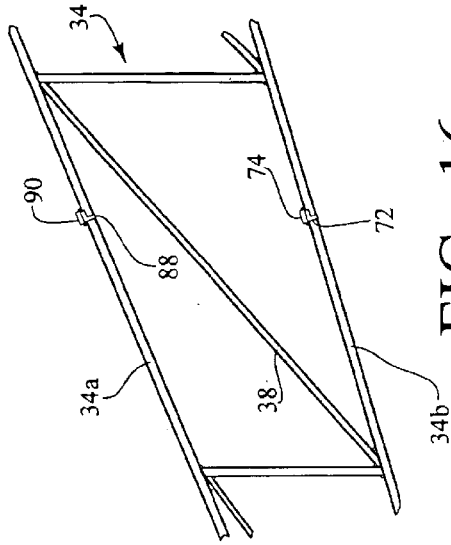
FIG. 16 shows a side elevation view of a portion of one of the trusses in the roof structure of FIGS. 12–15.

Referring now to FIGS. 12–16, there is shown, an alternative roof covering comprising a flexible, waterproof, tarpaulin 86 which can be used to cover the roof structure 22 of the previous example, by making a few modifications, in place of corrugated sheet metal roofing 32. One of the modifications is in the use of angle iron upper cross-braces 88 (See FIG. 16) between adjacent pairs of the upper truss beams 34*a* in place of the wood board cross braces 49 and saddle hangers 51 of the previous example. The upper cross braces 88 are bolted on end portions thereof to rectangular plates 90 welded to an upper surface of the upper beams 34*a* in the same manner as the cross braces 72 of the lower beams 34*b* are fastened to the plates 74, as shown in FIGS. 5–6 and 16. Only a pair of the upper cross braces 88 need be used to adequately stabilize the upper beams 34*a* when using the tarpaulin 86, one of which upper cross braces is located in each of the two central sections of each of the trusses 34, similar to the placement of the two lower cross braces 72 as shown in FIG. 5.

Figure 13:
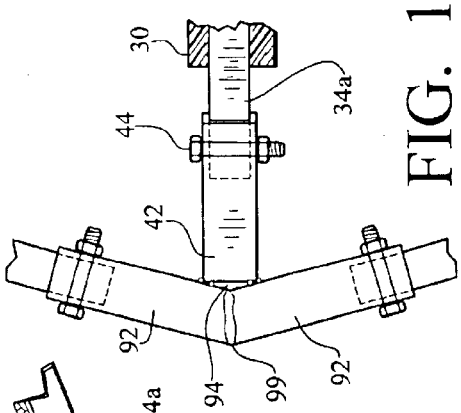
FIG. 13 shows a top plan view of the roof structure portion of FIG. 12 with the tarpaulin removed.
Figure 12:
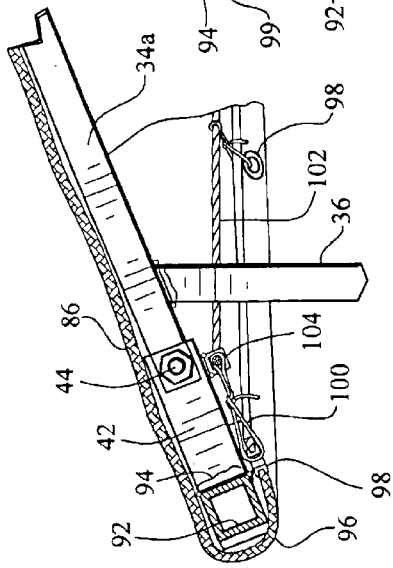
FIG. 12 shows a partially cross-sectioned elevation view of a portion of roof structure similar to FIG. 7, except modified to replace the corrugated roofing with a tarpaulin.

The only other modifications to the roof structure of the previous example needed for the use of the tarpaulin 86 is that shown in FIGS. 12–13 wherein the mounting plates 45*a* and 45*b* and the wood trim members 47*a* and 47*b* of the previous example are replaced by elongate box tubing peripheral members 92 such as shown in FIG. 12. The peripheral members 92 are preferably 2" by 2" box tubing to match the box tubing piece 42 to which they are welded at their abutting ends as at 94 in FIGS. 12–13.

Figure 14:
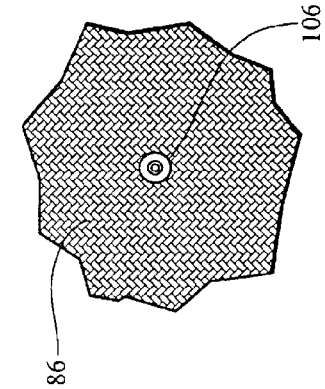
FIG. 14 shows a top plan view of a central portion of the roof structure of FIGS. 12–13.
Figure 15:
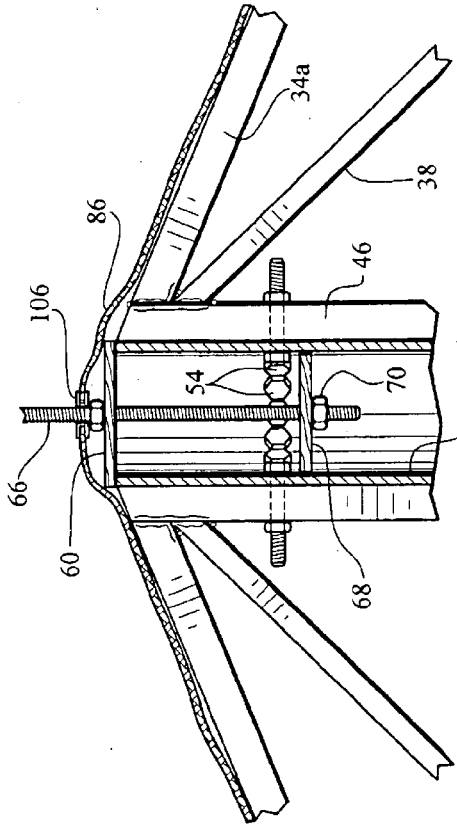
FIG. 15 shows a partially cross-sectioned side elevation view of the central portion of FIG. 14.

The circular tarpaulin 86 should be of sufficiently large diameter to permit outer edge portions to be wrapped around the peripheral members 92 and lapped back under the same as shown in FIG. 12 at 96. Outer edge portions of the tarpaulin 86 contain a series of eyelets 98, preferably about every 16 inches around the entire perimeter thereof. A length of cord 100 can be strung through each of the eyelets 98. Each of the cords 100 is then strung between each of the eyelets 98 and a peripherally extending steel cable 102 which is strung around an outer edge portion and underneath each of the upper beams 34*a* through a suitable eye screw or eyelet 104 fastened or welded to each of the upper beams 34*a* (See FIG. 12). An eyelet 106 is placed at the center of the tarpaulin 86 through which the pin 66 can be extended as shown in FIGS. 14–15. By using the tarpaulin 86 of the present example, the cone shaped cap 62 of the previous example will not be needed and can be omitted if desired, as indicated by its absence in FIG. 15.

In conclusion, it will be apparent that the roof structure of my invention may contain as few as three triangular segments, as viewed in the plan. That is to say, these may be as few as three trusses 34 rotationally displaced from adjacent ones of the trusses, preferably by 120 degrees as measured in a horizontal plane, or as many more than three as considered practical, including, if desired, more than the twelve trusses and segments as contained in the roof structure 22 of the present example. In any case, it is preferable that horizontal angle of displacement of each of the trusses from adjacent ones of the trusses be equal around the entire roof structure.

Although the present invention has been shown and described with respect to specific details of a certain preferred embodiment thereof, it is not intended that such details limit the scope and coverage of this patent other than as expressly set forth in the following claims, making allowance for reasonable equivalents thereof.

I claim:

1. In a building, a roof structure comprising an essentially non-load supporting, vertically extending central column having a lower end spaced above a supporting structure of said roof structure; and a plurality of at least three elongated and vertically inclined, multi-element trusses fixedly joined on innermost ends thereof to said central column and being rotationally displaced from one another in a horizontal plane, each of said trusses extending radially outwardly and downwardly from said central column to an outer end portion thereof for mounting on a weight bearing supporting structure at a level spaced above the supporting surface of said building and below the lower end of said column, said plurality of trusses thereby defining a roof structure in the form of a cone shaped polygon, wherein each of said trusses comprises an upper beam which is vertically inclined at a first angle relative to horizontal and a lower beam disposed below said upper beam which is inclined at a second angle relative to horizontal, said first angle being greater than said second angle such that corresponding ends of said upper beam and said lower beam at an innermost end of each of said trusses are vertically spaced apart to a greater extent than are opposite corresponding ends of said upper beam and said lower beam at an outermost end of each of said trusses and are fixed in position relative to upper and lower end portions of said central column, respectively.

2. The building of claim 1 wherein each of said multi-element trusses is rotationally displaced in said horizontal plane from adjacent ones of said trusses by essentially the same angle of displacement.

3. The building of claim 1 wherein each of the said multi-element trusses comprises an elongate upper beam;

an elongate lower beam spaced below said upper beam;

a plurality of vertically extending spacer members radially spaced apart and connected between said beams to form a series of truss sections between adjacent ones of said spacer members; and a series of diagonally extending elongate reinforcing members, a different one of said reinforcing members being disposed in each of said truss section, each of said reinforcing members being connected on a lower, radially outer end thereof to an intersection between said lower beam and one of said spacer members on a radially outer end of a corresponding one of said truss sections, and being connected on an upper, radially inner end thereof to an intersection between said upper beam and one of said spacer members on a radially inner end of said corresponding one of said truss sections.

4. The building of claim 3 wherein said upper beam is inclined at a first vertical angle relative to horizontal and said lower beam is inclined at a second vertical angle relative to horizontal, said second angle being less than said first angle.

5. The building of claim 4 wherein said first angle is about 22 degrees and said second angle is about 16 degrees.

6. The building of claim 3 wherein said roof structure further comprises a first series of radially spaced apart cross-braces adjoined on opposite end portions thereof between adjacent pairs of said lower beams.

7. The building of claim 6 wherein said first series of cross-braces comprises elongate steel angle iron members.

8. The building of claim 7 further comprising a series of overhanging steel plates attached on a central portion thereof to each of said lower beams, said first series of angle iron members being joined to said plates by fasteners.

9. The building of claim 3 wherein said roof structure further comprises a second series of radially spaced apart cross-braces adjoined on opposite end portions thereof between adjacent pairs of said upper beams.

10. The building of claim 9 wherein said second series of cross-braces comprises elongate wood boards.

11. The building of claim 10 further comprising a series of saddle hangers attached to each of said upper beams, end portions of each of said wood boards being disposed in and fastened to a different one of said saddle hangers.

12. The building of claim 3 wherein said roof structure further comprises a first series of radially spaced apart cross-braces adjoined or opposite end portions thereof between adjacent pairs of said lower beams and a second series of radially spaced apart cross-braces adjoined on opposite end portions thereof between adjacent pairs of said upper beams.

13. The building of claim 3 wherein said series of truss sections is four.

14. The building of claim 3 wherein said upper beam, said lower beam, said spacer members and said reinforcing members of each of said trusses are constructed of hollow box tubing.

15. The building of claim 3 wherein said upper be is inclined at a first vertical angle relative to horizontal.

16. The building of claim 1 wherein each of said trusses comprises a plurality of beams made of hollow box tubing.

17. The building of claim 1 wherein each of said trusses comprises, an elongate upper beam being inclined at a first vertical angle relative to horizontal and an elongate lower beam disposed under said upper beam, said upper beam being connected to said lower beam by a series of vertically extending and radially spaced apart spacer members forming a series of truss sections between adjacent ones of said spacer members, said lower beam being inclined at a second vertical angle relative to horizontal which is less than said first angle.

18. The building of claim 1 wherein said weight bearing support comprises a plurality of elongate posts equal to said plurality of trusses, each of said posts supporting said outer end portion of a different one of said trusses.

19. The building of claim 1 wherein said roof structure further comprises a series of radially spaced apart cross-braces adjoined on opposite end portions thereof between adjacent pairs of said trusses.

20. The building of claim 1 where each of said trusses further comprises a vertically extending spacer member connected on opposite end portions to and extending between corresponding ends of said upper beam and said lower beam at said innermost end, said spacer member also being connected on opposite end portions to said central column.

21. The building of claim 20 wherein said spacer member is removably connected to said central column.

22. The building of claim 20 wherein said spacer member is connected to said central column by means of at least three nut and bolt combinations, a first one of said combinations adjoining an upper end portion of said spacer member to an upper end portion of said central column immediately below an intersection of said upper beam with said spacer member, the other two of said combinations adjoining a lower end portion of said sparer member with said central column immediately above and below an intersection of said lower beam with said spacer member.

23. In a building, a roof structure comprising an essentially non-load supporting, vertically extending central column having a lower end spaced above a supporting structure of said roof structure; and a plurality of at least three elongated and vertically inclined, multi-element trusses fixedly joined on innermost ends thereof to said central column and being rotationally displaced from one another in a horizontal plane, each of said trusses extending radially outwardly and downwardly from said central column to an outer end portion thereof for mounting on a weight bearing supporting structure at a level spaced above the supporting surface of said building and below the lower end of said column, said plurality of trusses thereby defining a roof structure in the form of a cone shaped polygon wherein each of the said multi-element trusses comprises an elongate upper beam;

an elongate lower beam spaced below said upper beam;

a plurality of vertically extending spacer members radially spaced apart and connected between said beams to form a series of truss sections between adjacent ones of said spacer members; and a series of diagonally extending elongate reinforcing members, a different one of said reinforcing members being disposed in each of said truss section, each of said reinforcing members being connected on a lower, radially outer end thereof to an intersection between said lower beam and one of said spacer members on a radially outer end of a corresponding one of said truss sections, and being connected on an upper, radially inner end thereof to an intersection between said upper beam and one of said spacer members on a radially inner end of said corresponding one of said truss sections wherein a radially outer end portion of each of said upper beams projects outwardly beyond a corresponding outermost one of said sparer members, an outer end of each of said upper beams being connected to an angular intersection between two adjoining mounting plates, a series of elongate wood board trim members being connected on end portions thereof to said mounting plates to form a polygonal peripheral border around said roof structure.

24. In a building, a roof structure comprising an essentially non-load supporting, vertically extending central column having a lower end spaced above supporting structure of said roof structure; and a plurality of at least three elongated and vertically inclined, multi-element trusses fixedly joined on innermost ends thereof to said central column and being rotationally displaced from one another in a horizontal plane, each of said trusses extending radially outwardly and downwardly from said central column to an outer end portion thereof for mounting on a weight bearing supporting structure at a level spaced above the supporting surface of said building and below the lower end of said column, said plurality of trusses thereby defining a roof structure in the form of a cone shaped polygon, wherein each of the said multi-element trusses comprises an elongate upper beam;

an elongate lower beam spaced below said upper beam;

a plurality of vertically extending spacer members radially spaced apart and connected between said beams to form a series of truss sections between adjacent ones of said spacer members; and a series of diagonally extending elongate reinforcing members, a different one of said reinforcing members being disposed in each of said truss section, each of said reinforcing members being connected on a lower, radially outer end thereof to an intersection between said lower beam and one of said spacer members on a radially outer end of a corresponding one of said truss sections, and being connected on an upper, radially inner end thereof to an intersection between said upper beam and one of said spacer members on a radially inner end a said corresponding one of said truss sections wherein a radially outer end portion of said upper beam projects radially outwardly beyond a radially outermost one of said spacer members, the radially outermost one of said spacer members extending vertically downwardly below radially outer end of said lower beam, a lower end portion of the radially outermost one of said spacer members located below said lower beam being attached to said weight bearing support.

* * * * *